US009175468B1

(12) United States Patent
Tsai

(10) Patent No.: US 9,175,468 B1
(45) Date of Patent: Nov. 3, 2015

(54) SHOCK SUPPRESSOR

(71) Applicant: Chong-Shien Tsai, Taichung (TW)

(72) Inventor: Chong-Shien Tsai, Taichung (TW)

( * ) Notice: Subject to any disclaimer, the term of this patent is extended or adjusted under 35 U.S.C. 154(b) by 0 days.

(21) Appl. No.: 14/327,353

(22) Filed: Jul. 9, 2014

(51) Int. Cl.
*E04B 1/98* (2006.01)
*E04B 1/36* (2006.01)
*E01D 19/04* (2006.01)

(52) U.S. Cl.
CPC ..... *E04B 1/985* (2013.01); *E01D 19/04* (2013.01); *E04B 1/36* (2013.01)

(58) Field of Classification Search
CPC ..... E04H 9/02; E04H 9/021; E04B 1/98
USPC ..... 52/1, 167.1, 167.2, 167.4, 167.5, 167.6, 52/167.7, 167.8, 167.9; 248/636, 560, 248/562, 566, 569, 583
See application file for complete search history.

(56) References Cited

U.S. PATENT DOCUMENTS 5,597,239 A * 1/1997 Scaramuzza et al. ..... 384/36
6,021,992 A * 2/2000 Yen et al. ..... 248/560
6,688,051 B2 2/2004 Tsai
6,820,380 B2 * 11/2004 Tsai ..... 52/167.4
6,862,849 B2 * 3/2005 Kim ..... 52/167.9
8,307,586 B2 * 11/2012 Tsai ..... 52/167.9
2005/0241245 A1 * 11/2005 Tsai ..... 52/167.1
2006/0174555 A1 * 8/2006 Zayas et al. ..... 52/167.4
2007/0044395 A1 * 3/2007 Lu et al. ..... 52/167.4
2008/0098671 A1 * 5/2008 Tsai ..... 52/167.6
2010/0095608 A1 * 4/2010 Marioni ..... 52/167.4
2012/0174500 A1 * 7/2012 Yakoub ..... 52/167.4

FOREIGN PATENT DOCUMENTS

TW 554124 9/2003
TW 585955 5/2004

OTHER PUBLICATIONS

English abstract translation for TW554124 and TW585955.

* cited by examiner

*Primary Examiner* — Beth Stephan
(74) *Attorney, Agent, or Firm* — WPAT, P.C.; Anthony King

(57) ABSTRACT

A shock suppressor has a first base, a second base, a sliding tray and a slider. The first base has a first guiding recess. The second base is mounted above the first base at an interval and has a second guiding recess facing the first guiding recess of the first base. The sliding tray is slidably mounted in the first guiding recess of the first base and has a sliding recess and a convex surface slidably mounted on and abutting against the first base in the first guiding recess. The slider is slidably mounted between the sliding recess of the sliding tray and the second guiding recess of the second base and has two convex faces. The abutments between the first base, the sliding tray, the slider and the second base can provide three concave sliding mechanisms to the shock suppressor.

14 Claims, 7 Drawing Sheets

SHOCK SUPPRESSOR

BACKGROUND OF THE INVENTION

1. Field of the Invention

The present invention relates to a shock suppressor, and more particularly to a shock suppressor that can absorb or dissipate seismic shock energy in both horizontal and vertical directions, has a simplified structure and can slide with three concave sliding mechanisms.

2. Description of Related Art

A conventional shock suppressor can be applied on a building, a bridge or a sensitive equipment to absorb or dissipate seismic shock energy. The applicant has previously proposed a seismic energy converter as disclosed in Taiwan Patent Number TW554124 and a shock absorber structure as disclosed in Taiwan Patent Number TW585955. The conventional shock suppressor has a first base, a second base and a slider. The first base has a top side and a first sliding recess. The first sliding recess is curved and is formed in the top side of the first base. The second base is parallel to the first base at an interval and has a bottom side and a second sliding recess. The second sliding recess is curved, is formed in the bottom side of the second base and faces the first sliding recess of the first base. The slider is slidably mounted between the bases and abuts against the sliding recesses in a curved-contact-surface manner.

With the curved-contact-surface structural relationship between the sliding recesses of the bases and the slider, the slider can be automatically relocated to the original position. When an earthquake or a vibration occurs, the bases and the slider of the conventional shock suppressor can be moved relative to each other in both horizontal and vertical directions, and this can isolate the transmittance of shock energy generated by the earthquake or the vibration and can absorb the shock energy to provide an isolating-damping effect to the building, the bridge or the sensitive equipment.

The conventional shock suppressor can dissipate shock energy by the curved-contact-surface structural relationship between the sliding recesses of the bases and the slider, but only two sliding recesses of the conventional shock suppressor are used to isolate and dissipate the shock energy, and this limits the isolation speed and efficiency of the conventional shock suppressor. Then, when an isolation device that requires a large-scale and rapid damping condition is in use, the user only can increase the number or size of the conventional shock suppressor to meet the above-mentioned requirement. However, increasing the number of the conventional shock suppressor may increase the equipment cost, and increasing the size of the conventional shock suppressor may complicate the structure of the conventional shock suppressor, and increase the equipment cost and difficulty of installation.

To overcome the shortcomings, the present invention tends to provide a shock suppressor to mitigate or obviate the aforementioned problems.

SUMMARY OF THE INVENTION

The main objective of the invention is to provide a shock suppressor that can absorb or dissipate seismic shock energy in both horizontal and vertical directions, has a simplified structure and can slide with three concave sliding mechanisms.

The shock suppressor in accordance with the present invention has a first base, a second base, a sliding tray and a slider. The first base has a first guiding recess. The second base is mounted above the first base at an interval and has a second guiding recess facing the first guiding recess of the first base. The sliding tray is slidably mounted in the first guiding recess of the first base and has a sliding recess and a convex surface slidably mounted on and abutting against the first base in the first guiding recess. The slider is slidably mounted between the sliding recess of the sliding tray and the second guiding recess of the second base and has two convex faces. The abutments between the first base, the sliding tray, the slider and the second base can provide three concave sliding mechanisms to the shock suppressor.

Other objects, advantages and novel features of the invention will become more apparent from the following detailed description when taken in conjunction with the accompanying drawings.

DETAILED DESCRIPTION OF PREFERRED EMBODIMENT

A shock suppressor in accordance with the present invention can be applied to a building, a bridge, precision instrument or wafer fabrication equipment, and comprises a first base 10, a second base 20, a sliding tray 30 and a slider 40. The first base 10 can be mounted on the ground, the floor or a building. The second base 20 is mounted above the first base 10 and is parallel to the first base 10 at an interval. The sliding tray 30 is slidably mounted in the first base 10. The slider 40 is slidably mounted between the sliding tray 30 and the second base 20. In addition, the locations of the first base 10 and second base 20 can be exchanged based on different needs.

Figure 1:
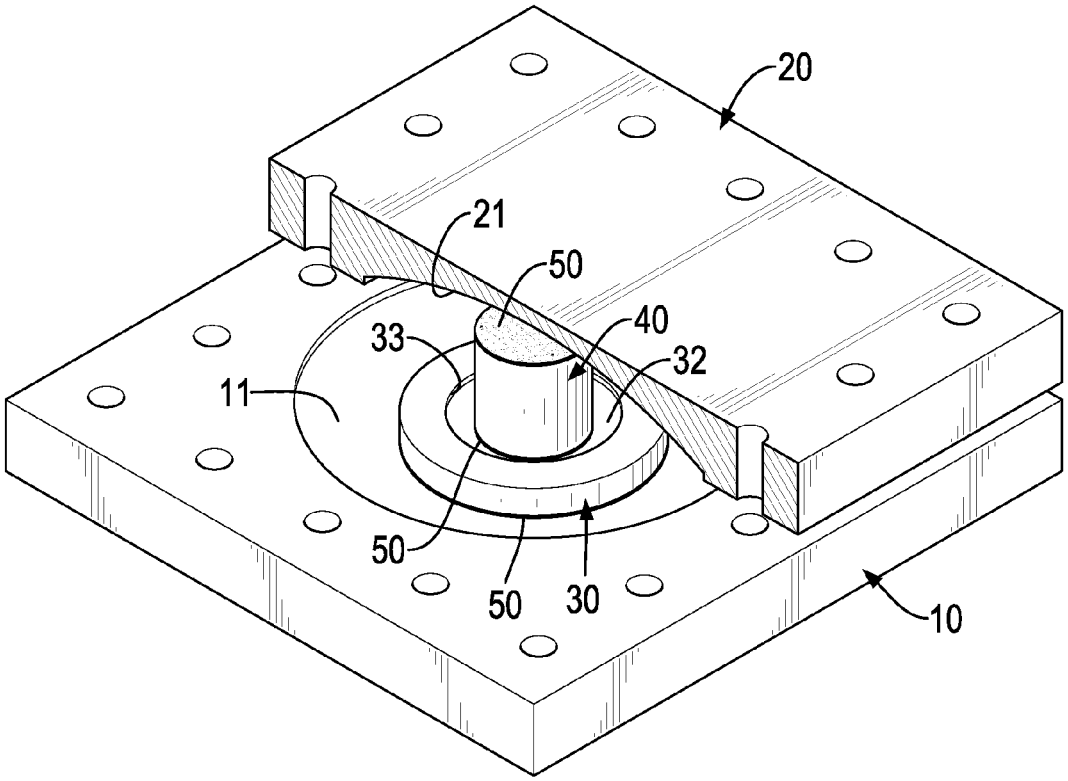
FIG. 1 is a perspective view in partial cross section of a first embodiment of a shock suppressor in accordance with the present invention.
Figure 2:
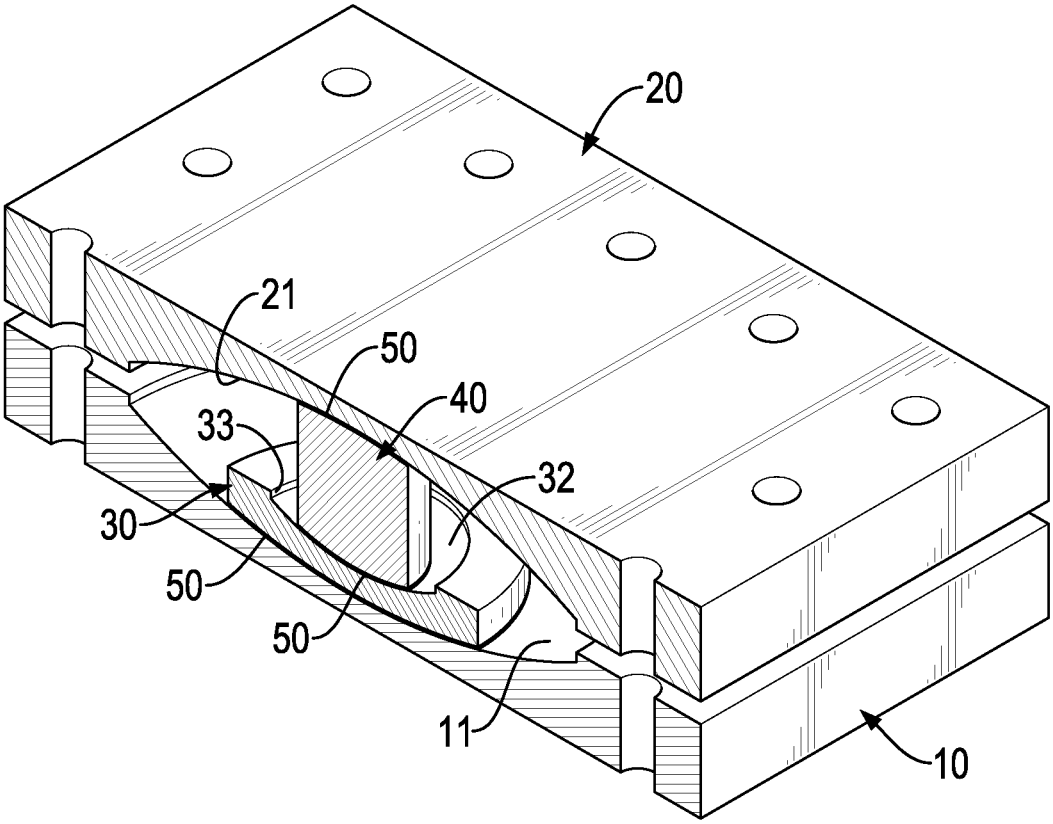
FIG. 2 is a perspective view of the shock suppressor in FIG. 1.

With reference to FIGS. 1 and 2, a first embodiment of a shock suppressor in accordance with the present invention has a first base 10, a second base 20, a sliding tray 30 and a slider 40. The first base 10 has a top side and a first guiding recess 11. The first guiding recess 11 is curved and is formed in the top side of the first base 10. The second base 20 is mounted above the first base 10 at an interval and has a bottom side and a second guiding recess 21. The bottom side of the second base 20 faces the top side of the first base 10. The second guiding recess 21 is curved, is formed in the bottom side of the second base 20 and faces the first guiding recess 11 of the first base 10.

The sliding tray 30 is round, is slidably mounted in the first guiding recess 11 of the first base 10 and has a size, a bottom side, a top side, a convex surface 31, a sliding recess 32 and a limiting flange 33. The size of the sliding tray 30 is smaller than a size of the first guiding recess 11 of the first base 10. The convex surface 31 is formed on the bottom side of the sliding tray 30 and is slidably mounted on and abuts against the first base 10 in the first guiding recess 11. The sliding recess 32 is formed in the top side of the sliding tray 30 and faces the second guiding recess 21 of the second base 20. The limiting flange 33 is annularly formed on and protrudes from the top side of the sliding tray 30 around the sliding recess 32.

The slider 40 is a cylinder, is slidably mounted between the sliding recess 32 of the sliding tray 30 and the second guiding recess 21 of the second base 20, and has a bottom side, a top side, a first convex face 401 and a second convex face 402. The first convex face 401 is formed on the bottom side of the slider 40 and slidably abuts against the sliding tray 30 in the sliding recess 32. The second convex face 402 is formed on the top side of the slider 40 and slidably abuts against the second base 20 in the second guiding recess 21.

Figure 3:
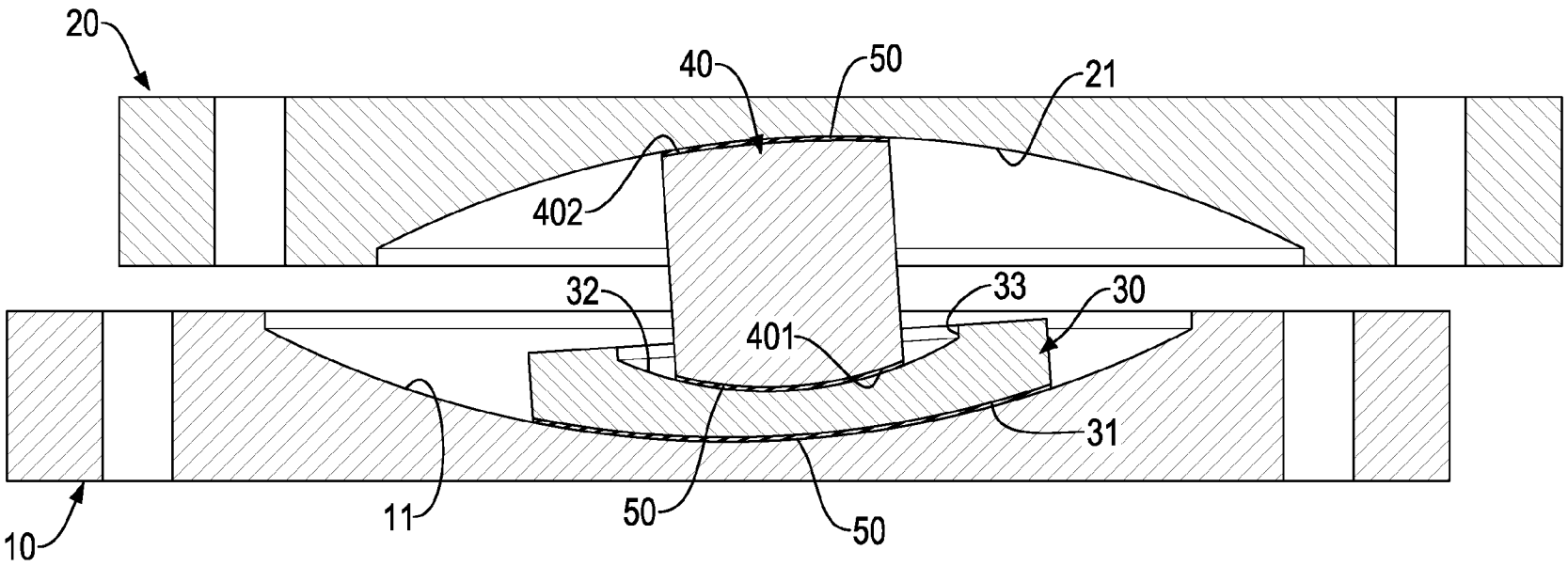
FIG. 3 is an operational side view of the shock suppressor in FIG. 1.

With reference to FIGS. 1 and 2, when the shock suppressor is in a normal state without an earthquake or a vibration, the connection between the sliding tray 30 and slider 40 can provide a supporting effect to the shock suppressor. With reference to FIG. 3, when an earthquake or a vibration occurs, the second base 20 is moved relative to the first base 10. The abutments between the first guiding recess 11 of the first base 10 and the convex surface 31 of the sliding tray 30, between the sliding recess 32 of the sliding tray 30 and the first convex face 401 of the slider 40, and between the second convex face 402 of the slider 40 and the second guiding recess 21 of the second base 20 can provide three concave sliding mechanisms to the shock suppressor. Then, the shock energy can be efficiently dissipated, eliminated, suppressed or absorbed in both horizontal and vertical directions by the misalignment and elevation between the bases 10, 20, the sliding tray 30 and the slider 40.

When the earthquake or the vibration has stopped, the first base 10 and the second base 20 will automatically move to an original position by the three concave sliding mechanisms between the first guiding recess 11 of the first base 10 and the convex surface 31 of the sliding tray 30, between the sliding recess 32 of the sliding tray 30 and the first convex face 401 of the slider 40, and between the second convex face 402 of the slider 40 and the second guiding recess 21 of the second base 20. Therefore, the shock suppressor in accordance with the present invention has an automatic repositioning effect to an original status.

In addition, with reference to FIGS. 1 to 3, a damping layer 50 is mounted on at least one of the contacting surfaces between the first base 10, the sliding tray 30, the slider 40 and the second base 20, and the damping layer 50 can be made of Teflon materials, resilient rubber materials, Viscoelastic materials, frictional materials or materials with an excellent damping coefficient that can eliminate or absorb the shock energy.

Figure 4:
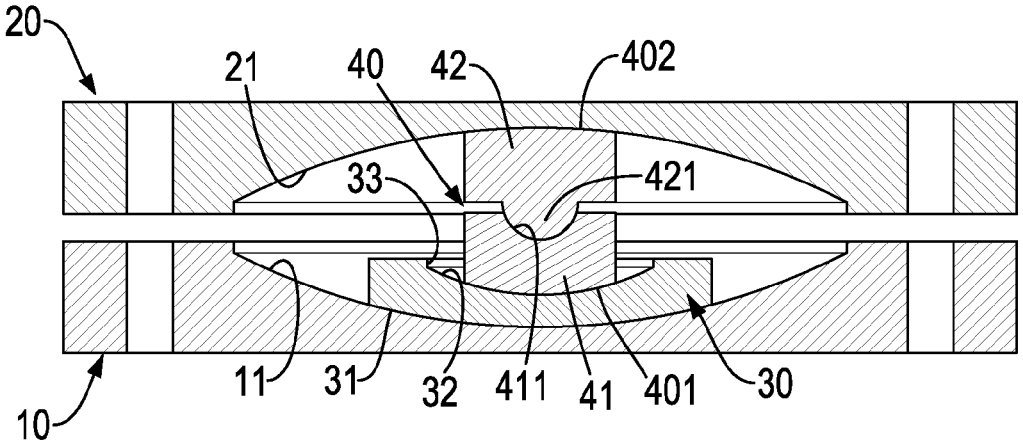
FIG. 4 is a side view of a second embodiment of a shock suppressor in accordance with the present invention.

With reference to FIG. 4, a second embodiment of the shock suppressor has a structure substantially same as that in the first embodiment except that the slider 40 has a first block 41, a second block 42 and a universal joint structure. The first block 41 abuts against the sliding tray 30 in the sliding recess 32. The second block 42 abuts against the second base 20 in the second guiding recess 21. The universal joint structure is mounted between the first block 41 and the second block 42 to connect the second block 42 with the first block 41 and has a concave recess 411 and a convex protrusion 421. The concave recess 411 is hemispherical, is formed in the first block 41 and faces the second block 42. The convex protrusion 421 is formed on and protrudes from the second block 42 and is rotatably mounted in the concave recess 411 of the first block 41. Then, the angle between the first block 41 and the second block 42 can be adjusted to enable the first base 10 and the second base 20 to be respectively mounted on the ground and the building at different positions and angles.

Figure 5:
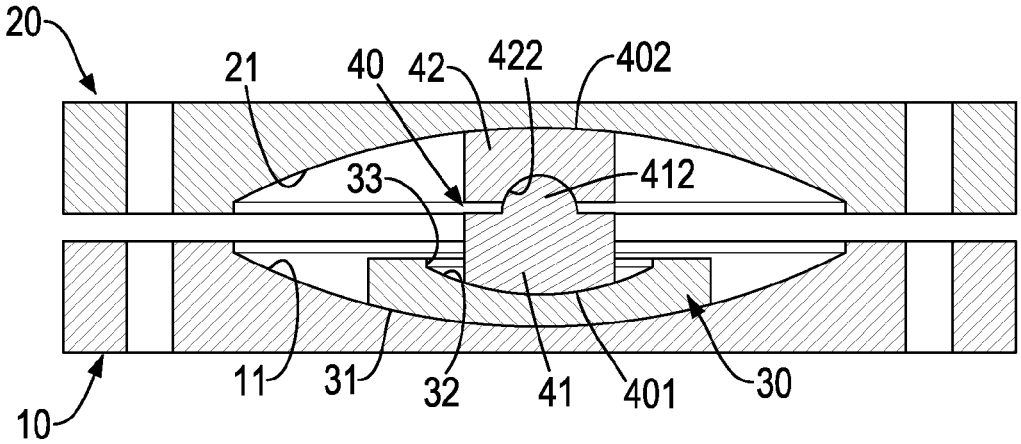
FIG. 5 is a side view of a third embodiment of a shock suppressor in accordance with the present invention.

With reference to FIG. 5, a third embodiment of the shock suppressor has a structure substantially same as that in the second embodiment except that the universal joint structure of the slider 40 has a convex protrusion 412 and a concave recess 422. The convex protrusion 412 is formed on and protrudes from the first block 41 and faces the second block 42. The concave recess 422 is formed in the second block 42, faces the first block 41 and is rotatably disposed around the convex protrusion 412 of the first block 41.

Figure 6:
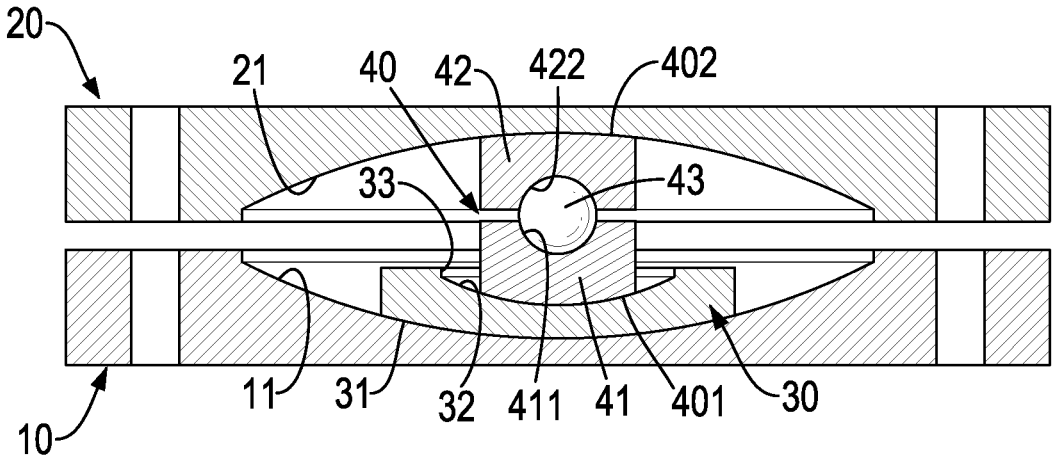
FIG. 6 is a side view of a fourth embodiment of a shock suppressor in accordance with the present invention.

With reference to FIG. 6, a fourth embodiment of the shock suppressor has a structure substantially same as that in the second embodiment except that the universal joint structure of the slider 40 has two hemispherical concave recesses 411, 422 and a connector 43. One of the concave recesses 411, 422 is formed in the first block 41 and the other concave recess 422 is formed in the second block 42 and faces the concave recess 411 that is formed in the first block 41. The connector 43 is spherical and is rotatably mounted between the concave recesses 411, 422 of the blocks 41, 42. Then, the angle between the first block 41 and the second block 42 can be adjusted to enable the first base 10 and the second base 20 to be respectively mounted on the ground and the building at different positions and angles, and this is versatile in use.

Figure 7:
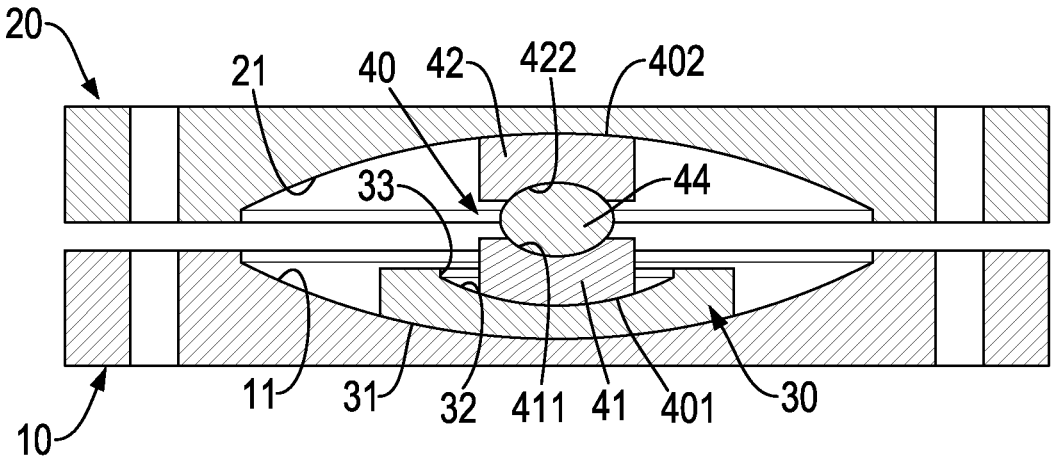
FIG. 7 is a side view of a fifth embodiment of a shock suppressor in accordance with the present invention.

With reference to FIG. 7, a fifth embodiment of the shock suppressor has a structure substantially same as that in the fourth embodiment except that the concave recesses 411, 422 are elliptically concaved and the connector 44 is elliptical.

According to the above-mentioned features and structural relationships of the shock suppressor, the shock suppressor as described has the following advantages.

1. The sliding tray 30 is mounted between the first base 10 and the slider 40 to form the three concave sliding mechanisms between the first base 10 and the second base 20. Compared with the conventional shock suppressor with two concave sliding mechanisms, the present invention can improve the isolation speed and efficiency of the shock suppressor.

2. The three concave sliding mechanisms are provided between the first base 10 and the second base 20 by mounting the sliding tray 30 between the first base 10 and the slider 40, and this can simplify the overall structure of the shock suppressor and reduce the cost of manufacturing the shock suppressor.

3. The angle between the first block 41 and the second block 42 of the slider 40 can be adjusted by the abutment of the connector 43, 44 to enable the first base 10 and the second base 20 to be respectively mounted on the ground and the building at different positions and angles, and this is versatile in use and can improve the installation flexibility and adaptability of the shock suppressor.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A shock suppressor comprising:

a first base having a top side; and a first guiding recess being curved and formed in the top side of the first base;

a second base mounted above the first base and having
a bottom side facing the top side of the first base; and
a second guiding recess being curved and round, formed in the bottom side of the second base and facing the first guiding recess of the first base;
a sliding tray slidably mounted in the first guiding recess of the first base and having
a bottom side;
a top side;
a convex surface formed on the bottom side of the sliding tray and slidably mounted on and abutting against the first base in the first guiding recess; and
a sliding recess formed in the top side of the sliding tray and facing the second guiding recess of the second base;
a slider slidably mounted between the sliding recess of the sliding tray and the second guiding recess of the second base and having
a bottom side;
a top side;
a first convex face formed on the bottom side of the slider and slidably abutting against the sliding tray in the sliding recess; and
a second convex face formed on the top side of the slider and slidably abutting against the second base in the second guiding recess;
wherein the shock suppressor has
a damping layer mounted on at least one of the convex surface of the sliding tray and the convex faces of the slider instead of the first guiding recess of the first base, the sliding recess of the sliding tray, and the second guiding recess of the second base, and
three concave sliding mechanisms defined between the first base and the second base, and respectively formed between the first guiding recess of the first base and the convex surface of the sliding tray, the sliding recess of the sliding tray and the first convex face of the slider, and the second convex face of the slider and the second guiding recess of the second base without abutting against each other to limit a sliding direction of the slider to enable the sliding tray, the slider, and the second base to freely and respectively slide and move relative to the first base in both horizontal and vertical directions; and
wherein one of the three concave sliding mechanisms is formed between the second base and the slider, and the other two of the three concave sliding mechanisms are formed between the slider and the first base to form an asymmetrical arrangement about the slider in the vertical direction.

2. The shock suppressor as claimed in claim 1, wherein the sliding tray has a limiting flange annularly formed on and protruding from the top side of the sliding tray around the sliding recess.

3. The shock suppressor as claimed in claim 1, wherein the slider has
a first block abutting against the sliding tray in the sliding recess;
a second block abutting against the second base in the second guiding recess; and
a universal joint structure mounted between the first block and the second block to connect the second block with the first block.

4. The shock suppressor as claimed in claim 2, wherein the slider has
a first block abutting against the sliding tray in the sliding recess;
a second block abutting against the second base in the second guiding recess; and
a universal joint structure mounted between the first block and the second block to connect the second block with the first block.

5. The shock suppressor as claimed in claim 3, wherein the universal joint structure of the slider has
a concave recess formed in the first block and facing the second block; and
a convex protrusion formed on and protruding from the second block and rotatably mounted in the concave recess of the first block.

6. The shock suppressor as claimed in claim 4, wherein the universal joint structure of the slider has
a concave recess formed in the first block and facing the second block; and
a convex protrusion formed on and protruding from the second block and rotatably mounted in the concave recess of the first block.

7. The shock suppressor as claimed in claim 3, wherein the universal joint structure of the slider has
a convex protrusion formed on and protruding from the first block and facing the second block; and
a concave recess formed in the second block, facing the first block and rotatably disposed around the convex protrusion of the first block.

8. The shock suppressor as claimed in claim 4, wherein the universal joint structure of the slider has
a convex protrusion formed on and protruding from the first block and facing the second block; and
a concave recess formed in the second block, facing the first block and rotatably disposed around the convex protrusion of the first block.

9. The shock suppressor as claimed in claim 3, wherein
the universal joint structure of the slider has two concave recesses, one of the concave recesses is formed in the first block and the other concave recess is formed in the second block and faces the concave recess that is formed in the first block; and
the slider has a connector rotatably mounted between the concave recesses that are respectively formed in the first block and the second block.

10. The shock suppressor as claimed in claim 4, wherein
the universal joint structure of the slider has two concave recesses, one of the concave recesses is formed in the first block and the other concave recess is formed in the second block and faces the concave recess that is formed in the first block; and
the slider has a connector rotatably mounted between the concave recesses that are respectively formed in the first block and the second block.

11. The shock suppressor as claimed in claim 9, wherein the connector of the slider is spherical.

12. The shock suppressor as claimed in claim 10, wherein the connector of the slider is spherical.

13. The shock suppressor as claimed in claim 9, wherein the connector of the slider is elliptical.

14. The shock suppressor as claimed in claim 10, wherein the connector of the slider is elliptical.

* * * * *